US008827876B2

(12) United States Patent
Shields

(10) Patent No.: US 8,827,876 B2
(45) Date of Patent: Sep. 9, 2014

(54) CHEST PRESS MACHINE

(76) Inventor: Michael Eamon Shields, Embro (CA)

( * ) Notice: Subject to any disclaimer, the term of this patent is extended or adjusted under 35 U.S.C. 154(b) by 245 days.

(21) Appl. No.: 13/616,420

(22) Filed: Sep. 14, 2012

(65) Prior Publication Data

US 2014/0080684 A1 Mar. 20, 2014

(51) Int. Cl.
*A63B 21/00* (2006.01)
*A63B 21/062* (2006.01)
*A63B 21/06* (2006.01)

(52) U.S. Cl.
USPC ..... 482/100; 482/93; 482/98; 482/99

(58) Field of Classification Search
CPC . A63B 21/1492; A63B 23/1254; A63B 23/12
USPC ..... 482/93–103
See application file for complete search history.

(56) References Cited

U.S. PATENT DOCUMENTS 4,614,338 A * 9/1986 Castillo ..... 482/98
4,949,951 A * 8/1990 Deola ..... 482/138
5,085,430 A * 2/1992 Habing ..... 482/100
5,967,954 A * 10/1999 Habing ..... 482/137
6,364,816 B1 * 4/2002 Tang et al. ..... 482/126
6,368,257 B1 * 4/2002 Kaplan et al. ..... 482/124
7,137,930 B1 * 11/2006 Carr ..... 482/98
7,384,381 B2 * 6/2008 Webber et al. ..... 482/100
7,922,632 B2 * 4/2011 Chou ..... 482/103
7,993,251 B1 * 8/2011 Webber et al. ..... 482/100
2002/0183175 A1 * 12/2002 Tang ..... 482/121
2003/0032530 A1 * 2/2003 Sechrest et al. ..... 482/94
2007/0160803 A1 * 7/2007 Grider ..... 428/100
2008/0300116 A1 * 12/2008 Eder ..... 482/100
2010/0285932 A1 * 11/2010 Fisher ..... 482/93

* cited by examiner

*Primary Examiner* — Stephen Crow
*Assistant Examiner* — Joshua Lee

(57) ABSTRACT

A chest press machine having a pair of converging exercise arms rotating around an arm pivot axle. Subsequent circular motion causes user's elbow extension to decelerate through the stroke. The direction of resulting force at start position is normal to direction of the resulting force at end position. A sweep arm attached to the exercise arm is attached via cords to some form of resistance. Changing leverage is exerted on the exercise arms as they rotate, thus counteracting the increasing difficulty of the stroke due to decreasing involvement of the tricep muscles. Attached to each exercise arm a hand-grip where gripped area rises from the horizontal to allow lateral movement of wrist through the stroke. The radius of the circular motion is adjusted by the telescoping hand-grip. As the exercise arms are pressed and squeezed together, the upper arms horizontally adduct, the elbows joints extend, and wrist joints move laterally.

7 Claims, 8 Drawing Sheets

CHEST PRESS MACHINE

CROSS-REFERENCE TO RELATED APPLICATIONS

Not Applicable

FEDERALLY SPONSORED RESEARCH

Not Applicable

BACKGROUND OF THE INVENTION

1. Field of Invention

This invention relates to exercise machines for pectoral muscle development.

2. Prior Art

Many different exercises are employed to exercise the chest and arms. The main types of exercises are (but not limited to); Bench Press, Dumbbell Flyes, Pec Deck, Dips, Pushups, and Cable Crossover.

The bench press and similarly pushups and dips, involve primarily the chest, triceps, and shoulder muscles. However, the chest muscles are involved mainly in that part of the motion where the weight is close to the users' chest. As the weight is moved upward and away from the chest, the triceps and shoulder muscles take over to complete the motion, essentially eliminating pectoral involvement.

Currently, the bench press is accomplished with either free weights or various machines designed to simulate the natural articulation of the arm and shoulder joints of a user with free weights. Utilizing the bench press with free weights a user can target upper, mid, and lower areas of the pectoral muscles by employing incline, flat, and decline movements respectively. A user can also target inner and outer areas of the pectoral muscles by varying the width of the hands as they grip a barbell. However, each targeted area requires a different positioning of the user. Therefore each targeted area must be addressed one at a time. Furthermore, in a typical press, the direction of the force applied by the user is static, typically in one direction, directly away from the user's chest.

Cable and dumbbell flyes provide resistance mainly in the early stages and diminishes as the arms move upward. This is improved somewhat with cable-flyes.

The pec deck provides resistance throughout the entire movement. However, use of this machine can over time cause shoulder problems for some individuals due to hyper-abduction of the shoulder.

SUMMARY OF THE INVENTION

The present invention is a machine specifically designed to work the pectoral muscles although the tricep, bicep, and shoulder muscles assist with the work.

The user targets in one motion the outer, mid and inner areas of the pectoral muscles. From the seated and forwardly leaning position and using a wide grip, the stroke consists of a pressing motion at the start position which is transitioned into a chest flye motion at the end position as the hands are brought together towards the mid-line of the body. As each exercise arm is pressed and rotated about the arm pivot axle, the upper arms are horizontally adducted, the elbows extend, and the wrist joints move laterally. Since the stroke moves through a circular machine determined path, elbow extension will decelerate through the stroke, thus reducing the involvement of the tricep muscles, and keeping the chest muscles heavily involved throughout the entire stroke. Furthermore, the direction of the resulting force acting on the exercise arms at the start position is normal to the resulting force acting on the exercise arms at the end position, through a full 90° of rotation, thus targeting a wide range of muscle fibers in the chest. As a result of the reducing involvement of the tricep muscles through the stroke, a method of increasing leverage is employed to counteract the increasing difficulty of the stroke. The arm pivot axle is inclined upwardly toward the user from the horizontal to allow the user's arms to stroke the exercise arms without interference from the rising sweep arms. Each exercise arm has a hand-grip attached to its outer end which can telescope to adjust for the user's arm length. The hand-grips are shaped such that one end has a pin selector hole for attachment to the exercise arm and the other end is the gripped area and is inclined upwardly from the horizontal. This upward inclination facilitates the lateral wrist movement as the user strokes the exercise arms. It is also possible for the user to change the amount of elbow extension of the stroke, and thus the amount of tricep involvement, by changing the angle that the user leans forward.

DETAILED DESCRIPTION OF THE INVENTION

Figure 1:
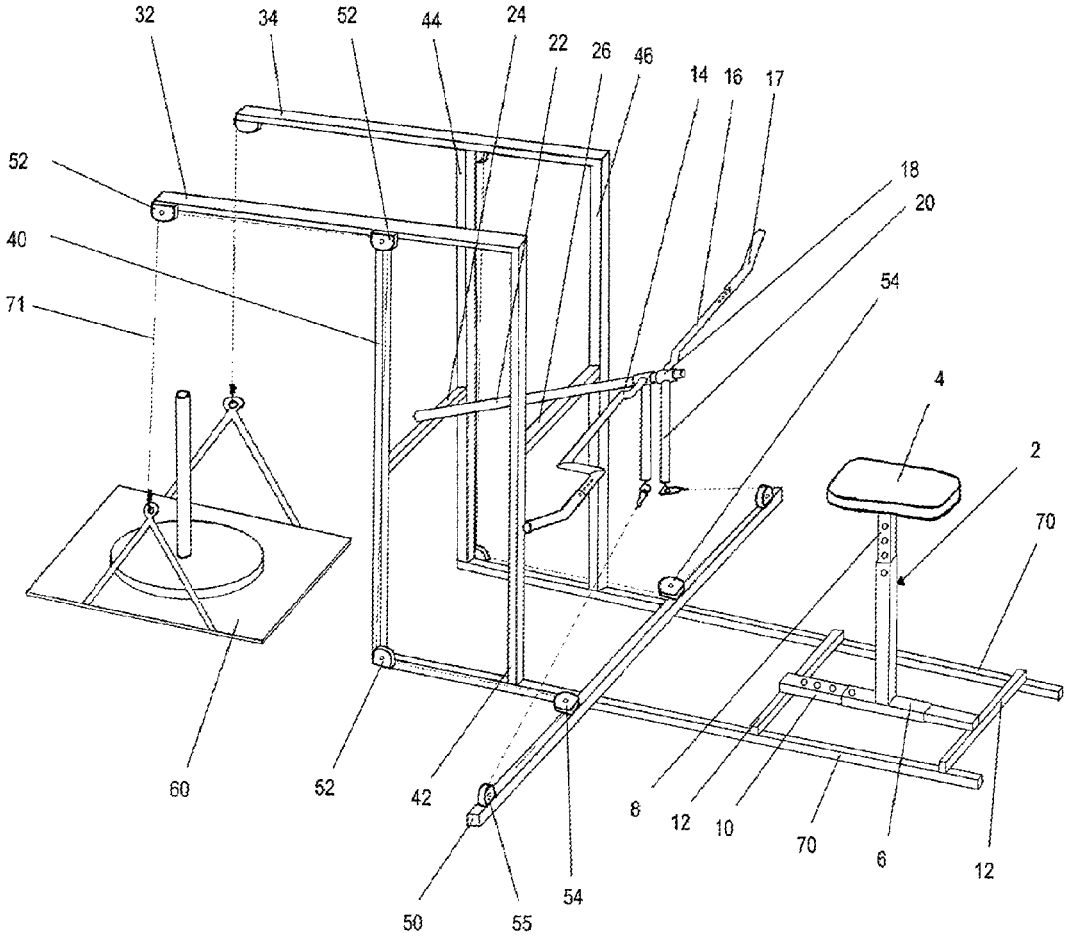
FIG. 1 is a perspective view of the chest press machine.

Referring now to the present invention in FIG. 1, the frame 70 and attached members are preferably steel tube and attached together using welds. The seat assembly 2 of which there is a seat 4. Attached to the seat 4 is the telescoping seat post 8 which can be adjusted up or down by sliding inside the horizontal seat slider 6. The seat assembly 2 is moved forward and backward by moving the horizontal seat slider 6 along the horizontal seat support member 10. The horizontal seat support member 10 is mounted on two separate seat assembly support members 12. The seat assembly support members 12 are mounted on the base frame 70. Rising from the base frame 70 are four stanchions, front stanchions 42,46 and rear stanchions 40,44. These four stanchions 40,42,44,46 support the left and right horizontal stack supports 32, 34 respectively as well as supporting the upper and lower arm pivot axle supports 26, 24 respectively.

Still referring to the present invention in FIG. 1, the arm pivot axle 22 is a round steel tube attached at the upper and lower arm pivot axle support frame members 26,24 respectively by welds. Unless stated otherwise, the preferred method of attaching components is by using welds. The exercise arms 14 and 16 are also round steel tubes and each is attached to the arm pivot axle 22 by way of separate sealed bearings 18 which have been fitted over the arm pivot axle 22. Furthermore, each exercise arm 14 and 16 has several pin selector holes bored into them. Attached to each of the exercise arms 14 and 16 are hand-grips 17. Each hand-grip 17 is formed from a steel tube and has a single pin selector hole bored into it. The hand-grips 17 are designed to slide onto each exercise arm 14 and 16 and positioned with selector pins (not shown), thus allowing the hand-grips 17 to telescope and accommodate the user's arm length. In this embodiment the exercise arm 14, being farther from the user than the exercise arm 16, is intersected by the exercise arm offset 15, which places both of the hand-grips 17 in the same plane when rotating around the arm pivot axle 22. Attached to each of the sealed bearings 18 is a sweep arm 20 constructed of round tube steel. Each sweep arm 20 is attached to each sealed bearing 18 in such a way as to be normal to the attached exercise arms 14 and 16. These sweep arms 20 lie in the same plane as their attached exercise arms 14 or 16 when rotating around the arm pivot axle 22. Furthermore, the sweep arms 20 must be of the appropriate length such that the sweep arm 20 attached to exercise arm 16 will not strike the opposing exercise arm 14 during the stroke. Exercise arms 14 and 16 are shaped such that there is an elevating jog on each arm close to the sealed bearing end of each exercise arm 14 and 16. This elevating jog vertically displaces each of the exercise arms 14 and 16 by a distance equivalent to the diameter of the exercise arms 14 and 16 themselves. This elevating jog on each of the exercise arms 14 and 16 allows enough clearance for the hands at the end of the stroke such that the user's hands will not collide with one another.

Figure 2:
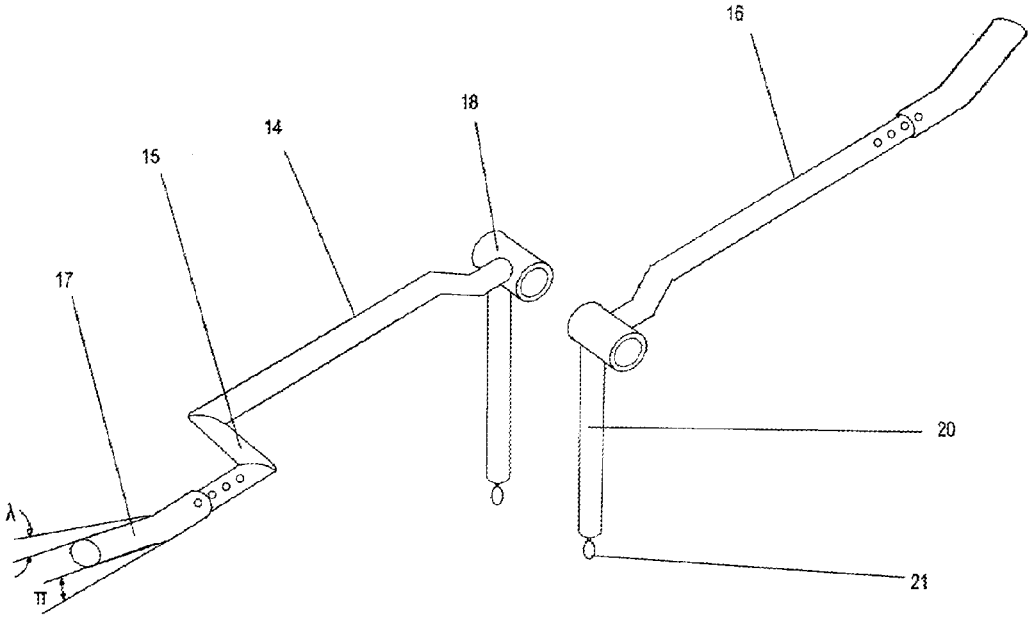
FIG. 2 is a perspective view of the exercise arms.

Still referring to the present invention in FIG. 1, the plate stack 60 is attached via cords 71 passing through five pulleys on either side of the machine. The plate stack 60 is designed to receive free weights. Each vertical mounted pulley 52, horizontal mounted pulley 54, and outer pulley 55 is placed in such a way on each side of the machine as to direct the path of the cords 71. Referring to FIGS. 1 and 2, the cords 71 begin at the plate stack 60, travel through each of the five pulleys and terminate at the sweep arm eye-bolt 21. The pulley base bar 50 is attached to the base frame 70 such that it is normal to and centered on, the base frame 70. The pulley base bar 50 lies behind the plane created by the hand-grips 17 opposite the user, as they are rotated around the arm pivot axle 22 such that the hand-grips 17 will not strike the cords 71 during the stroke. The arm pivot axle 22 is welded to its upper and lower support members 26,24 such that the arm pivot axle 22 rises towards the user from the horizontal. Each cord 71 is of the length required such that when attached, the exercise arms 14 and 16 will have a home position which is horizontal. Gravity acting on the exercise arms 14 and 16 will create a downward force which is countered by tension in the cords 71, assuming of course that the weight of the plate stack 60 exceeds the combined weight of the exercise arms 14 and 16.

Referring now to FIG. 2, this illustration is a perspective view of the exercise arms 14 and 16. Each hand-grip 17 is shaped such that the outer ends when mounted to the exercise arms 14 and 16 rise at an angle denoted by $\pi$. This outer end of the hand-grip 17 is the area gripped by the user and must be long enough to accommodate the hands while being gripped. Furthermore, the angle $\lambda$ denotes the angle that the hand-grips 17 are backwardly rotated towards the user. Once the hand-grips 17 are backwardly rotated by a value of $\lambda$, the angle $\pi$ rises from the horizontal. Therefore, at the start position of the stroke, the user's wrist is rotated by an angle of $\pi$ when grasping the hand-grips 17.

In further detail, still referring to the invention of FIG. 1 and FIG. 2, the user sits on the seat 4 and positions the height by adjusting the telescoping seat post 8 by inserting a selector pin (not shown). The user can adjust the distance of the seat 4 from the exercise arms 14 and 16 by moving the horizontal seat slider 6 along the horizontal seat support member 10 and inserting a selector pin (not shown). The user then telescopes the hand-grips 17 to a point where the user's hands and elbows would be vertically aligned when the hand-grips 17 are gripped and inserts a selector pin (not shown). The user grips each of the exercise arms 14 and 16 at the outer end of the hand-grips 17 with a wide overhand grip and leans forward such that the user's shoulder joints lie just above and behind the exercise arms 14 and 16. From this position, the exercise arms 14 and 16 are pressed through a circular path downward and squeezed inward toward the mid-line of the body where the hands will meet at the bottom of the stroke. As the exercise arms 14 and 16 are returned to the starting position, negative resistance is employed.

Figure 3:
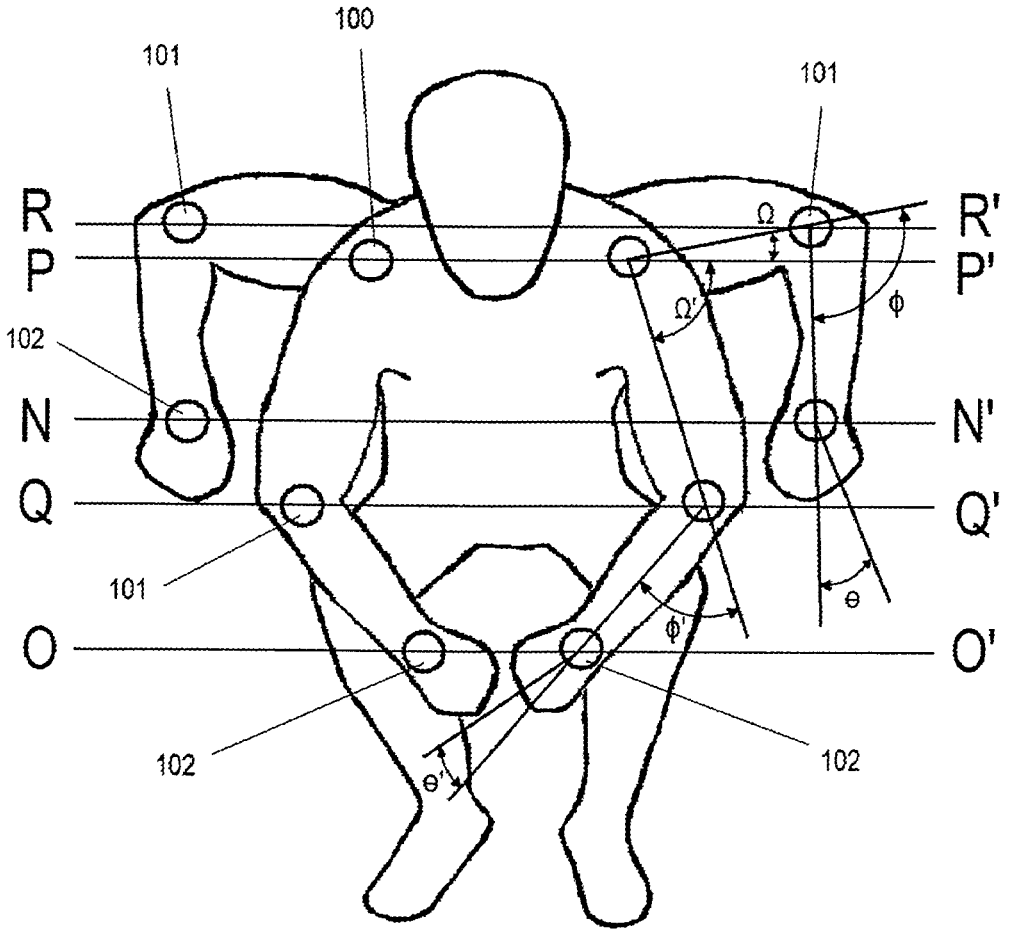
FIG. 3 is a front view illustration of the parameters of the user's arm movements from the starting to ending points of the movement and relative body position.

Referring now to FIG. 3, this frontal view illustration portrays the arm positions at the beginning and ending of the stroke of the exercise arms 14 and 16 through the circular path. The joints of the user are identified as, the wrist joint 102, elbow joint 101, and shoulder joint 100. A plane passing through the center of the shoulder joints 100 is denoted as P-P' and is parallel to the floor. Plane R-R' passes through the center of the elbow joints 101 at the start position of the stroke and is parallel to plane P-P'. Plane Q-Q' passes through the center of the elbow joints 101 at the end position of the stroke and is also parallel to plane P-P'. The amount of shoulder flexion at the start position of the stroke is defined by the angle $\Omega$. The amount of shoulder extension at the end position of the stroke is defined by the angle $\Omega'$. The total amount of shoulder movement is therefore, $\Omega+\Omega'$. The amount of elbow flexion at the start position of the stroke is defined by the angle $\Phi$. The amount of elbow flexion at the end position of the stroke is defined by the angle $\Phi'$. The total amount of elbow flexion over the course of the stroke is calculated as $\Phi$-$\Phi'$. Plane N-N' passes through the center of the wrist joints 102 at the start position of the stroke and is parallel to the floor. Plane O-O' passes through the center of the wrist joints 102 at the end position of the stroke and is parallel to N-N'. The amount of ulnar extension of the wrist joints 102 at the plane N-N' at the start position of the stroke to the neutral wrist position is defined by the angle $\theta$. The amount of radial flexion of the wrist joints 102 at the plane O-O' at the end position of the stroke from the neutral position is defined by the angle $\theta'$. The total amount of lateral wrist joint 102 movement is therefore $\theta+\theta'$. Furthermore, there must exist some elbow flexion at the end of the stroke denoted by $\Phi'$, to reduce strain on the elbow joint. As the user commences the stroke of the exercise arms 14 and 16, the upper arms are horizontally adducted, the elbow joints 101 extend, and the wrist joints 102 move laterally.

Figure 4:
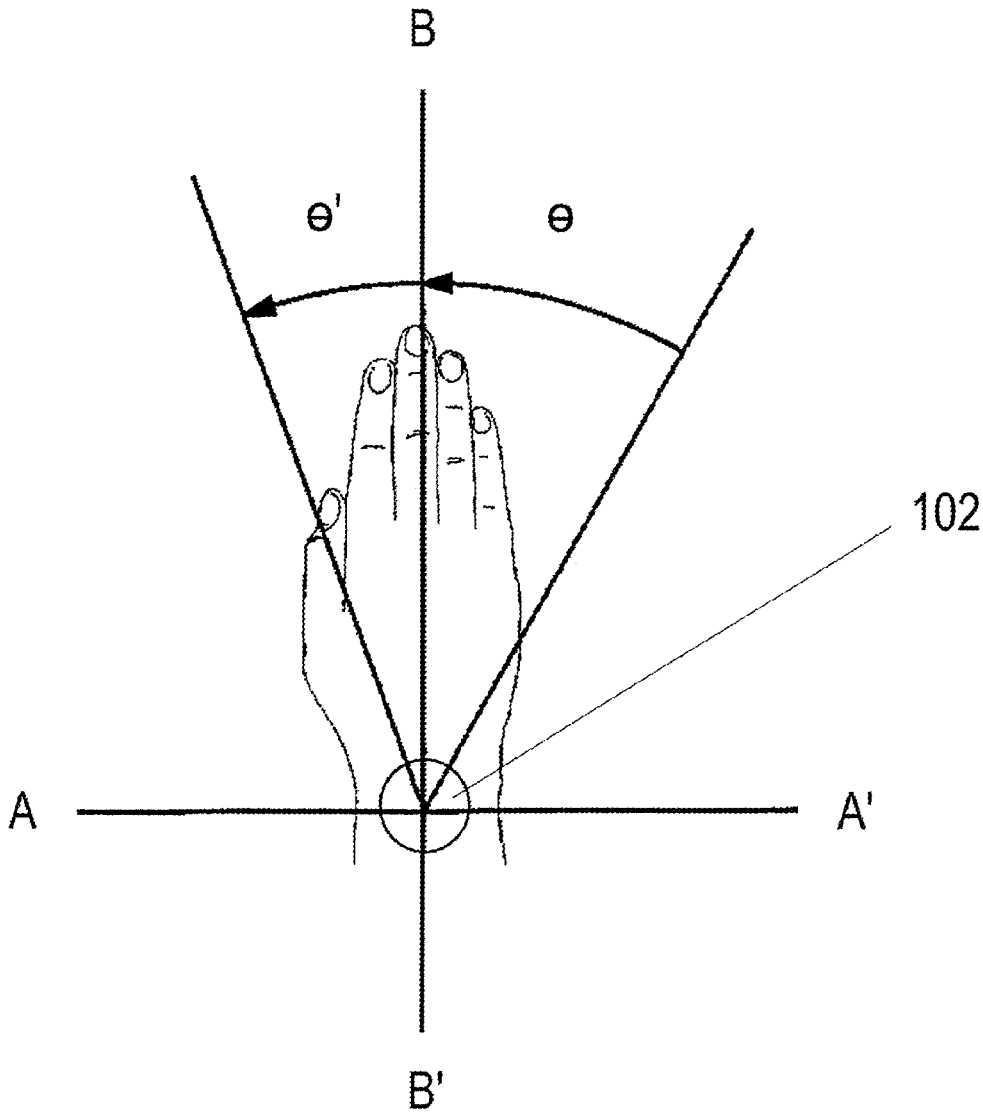
FIG. 4 is an illustration of the parameters of a user's wrist movements.

FIG. 4 is an illustration of a user's hand and wrist joint 102 in the neutral position and associated parameters. Plane B-B' passes through the center of the wrist joint 102 and delineates the neutral position of the wrist joint 102. Plane A-A' is normal to plane B-B' and also passes through the center of the wrist joint 102. From the start position of the stroke to the neutral position, the amount of ulnar extension of the wrist joint 102 is defined by the angle $\theta$. From the neutral position to the end of the stroke, the amount of radial flexion of the wrist joint 102 is defined by the angle $\theta'$. For the average individual, radial flexion is limited to 20° and ulnar flexion can range from 30° to 50°. Therefore the average individual can move the wrist laterally in a range of 50° to 80°.

Figure 5:
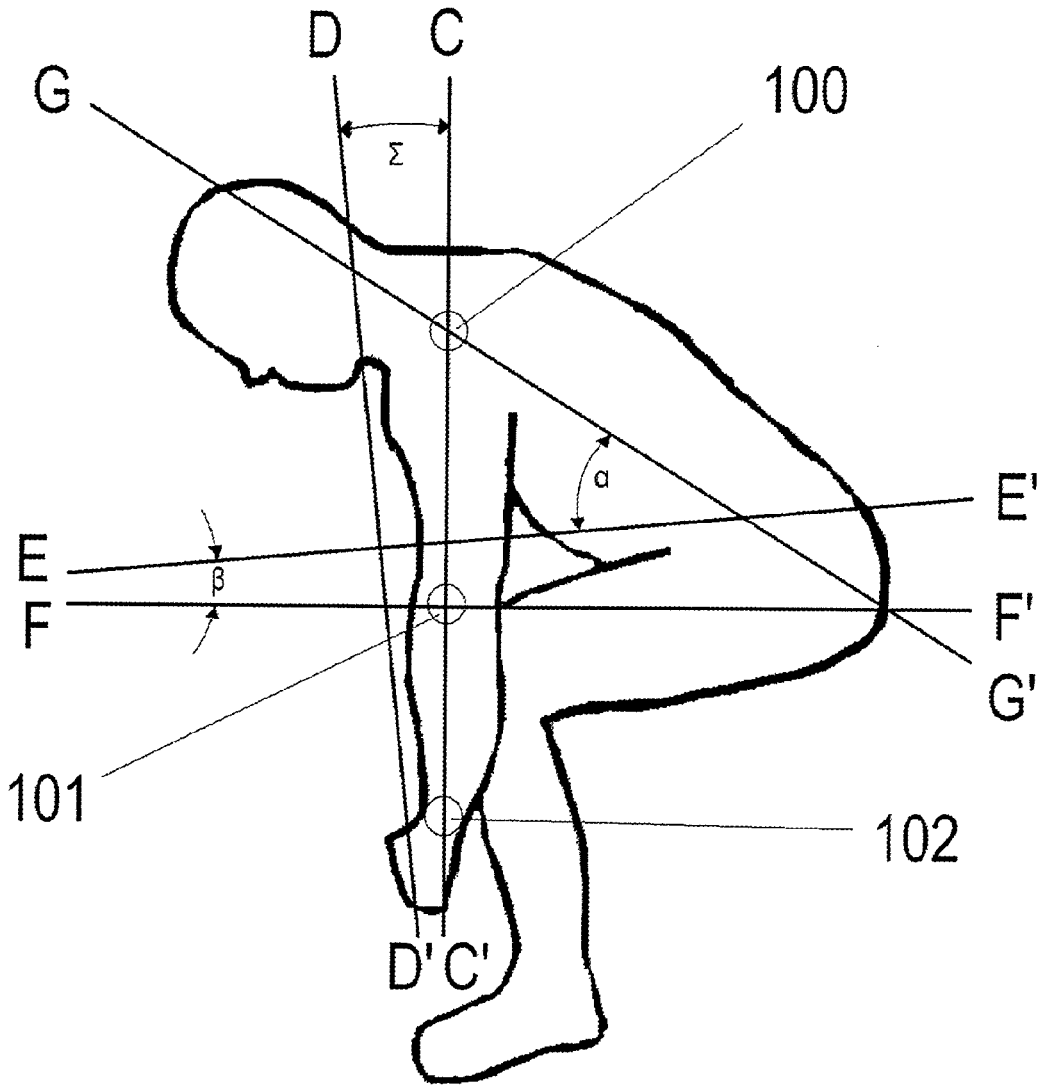
FIG. 5 is a side view illustration of the parameters of the user's arms and body position at the end position of the stroke.

FIG. 5 is a side view illustration of a user in the end position of the stroke and associated parameters. I will discuss the end position of the stroke here prior to the start position since understanding the best and most comfortable physical starting position of the user is determined by the best and most comfortable physical ending position of the user. Plane C-C' is a plane vertical to the floor and passes through the center of the shoulder joint 100, elbow joint 101, and wrist joint 102. Plane F-F' is a plane parallel to the floor. Plane D-D' represents the plane that the hand-grips 17 pass through during the stroke and is normal to plane E-E'. Plane E-E' is a plane coincident with the arm pivot axle 22 and rises from the horizontal at an angle of β from plane F-F'. The planes D-D' and C-C' must be displaced by an angle of Σ to prevent the user's arms downward movement from colliding with the sweep arms 20 as they rise during the stroke. Plane G-G' is a plane that passes from the shoulder joint 100 through the middle of the user's torso and intersects the plane E-E' at angle of α. The angle α denotes the forward lean angle of the user to perform the stroke. In operation, the user forwardly shifts his body towards the path of the hand-grips 17 as much as possible, towards plane D-D', such that the legs will not interfere with the path of the hand-grips 17 as they come together in front of the shins, at the end of the stroke. At the end of the stroke the user attains a maximum level of comfort when the user leans forward at a value for the angle of α, and a value for Σ such that the alignment of the center of the shoulder joint 100, elbow joint 101, and wrist joint 102 all lie in a vertical plane, the plane C-C'. This alignment of highest comfort will occur when Σ=β. From the data collected, a value of about 7° provides a good fit for the angle β. This configuration of the user's torso and arms yields the most comfortable position for the user to perform the stroke. It is important for the user only to move the arms and to maintain good form and maintaining the value for α throughout the stroke. It is possible for the user to increase the value of the angle α by not leaning as far forward at stroke's commencement. There is however a range available to the user. As α increases, the distance from the shoulder joint 100 to the hand-grips 17 at the end position of the stroke will increase, thus increasing the amount of elbow extension required to span the increased distance, and hence increasing the amount of lateral wrist movement required. Referring now to FIG. 3 and FIG. 5, as the user increases the value for α, the value for Ω will reduce. If the user increases α enough, Ω will disappear altogether and subsequently begin reducing the value of Ω'. However, the limiting factor of increasing α will be the total amount of elbow flexion required for the arms to span the increased distance from the user's shoulder joint 100 to the hand-grips 17 at the end of the stroke and the amount of lateral wrist movement to accommodate this changing elbow flexion. Add to this the fact that since the angle π of the hand-grips 17 to the exercise arms 14 and 16 is fixed, the range becomes more minimal without disturbing the user's firm grip on the hand-grips 17 through the stroke. A value of 25° for π is comfortable for the average user and supplies enough angular displacement for lateral rotation of the wrist joints 102 to complete the stroke without disturbing the user's firm grip. Furthermore, the angle λ must equal β for maximum comfort of the hands and wrist joints 102 through the stroke. When λ=β, π rises from the horizontal. The user can adjust their bodily positioning to accommodate their most comfortable, preferred position during the stroke.

Figure 6:
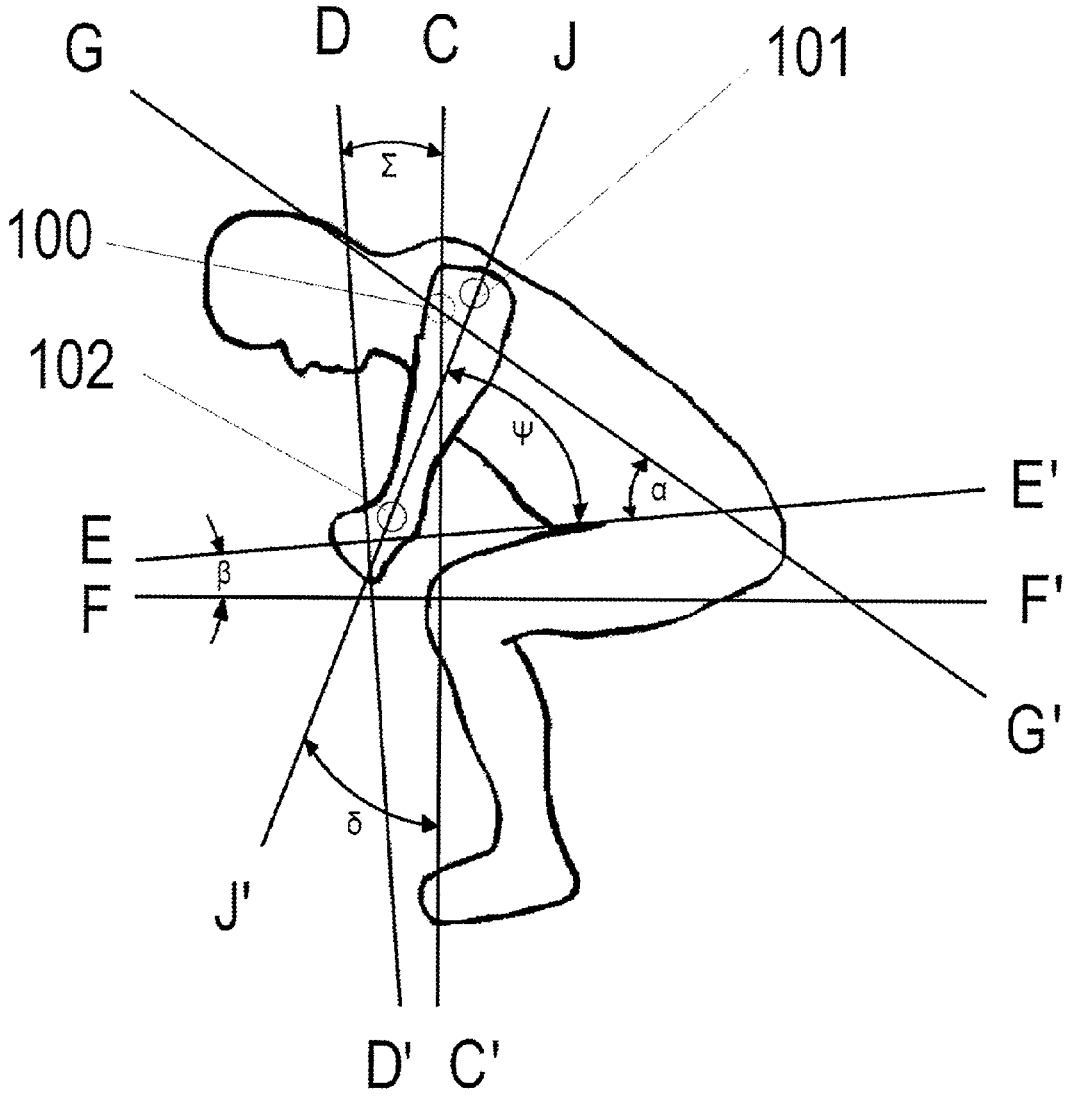
FIG. 6 is a side view illustration of the parameters of the user's arms and body position at the start position of the stroke.

FIG. 6 is a side view illustration of a user in the start position of the stroke and associated parameters. Plane C-C' is a vertical plane which passes through the center of the shoulder joint 100. Plane F-F' is a plane parallel to the floor. Plane D-D' represents the plane that the user's hand-grips 17 pass through during the stroke and is normal to plane E-E'. Plane E-E' is a plane coincident with the arm pivot axle 22 and rises from the horizontal at an angle of β from plane F-F'. The planes D-D' and C-C' are displaced by the angle of Σ. Plane G-G' is a plane that passes from the shoulder joint 100 through the middle of the user's torso and is coincident with the angle required for the user to lean forward to perform the stroke, the angle α. Plane J-J' is a plane that passes through the center of the elbow joint 101 and the wrist joint 102 , the forearm, and is displaced from plane E-E' by an angle of Ψ and from plane C-C' by an angle of δ. As the user begins the stroke, the value of Ψ will increase and the value of δ will decrease until plane J-J' becomes coincident with plane C-C' at the end of the stroke. Furthermore, the smaller the value for δ at the start position, the more comfortable the stroke becomes for the user.

Figure 7:
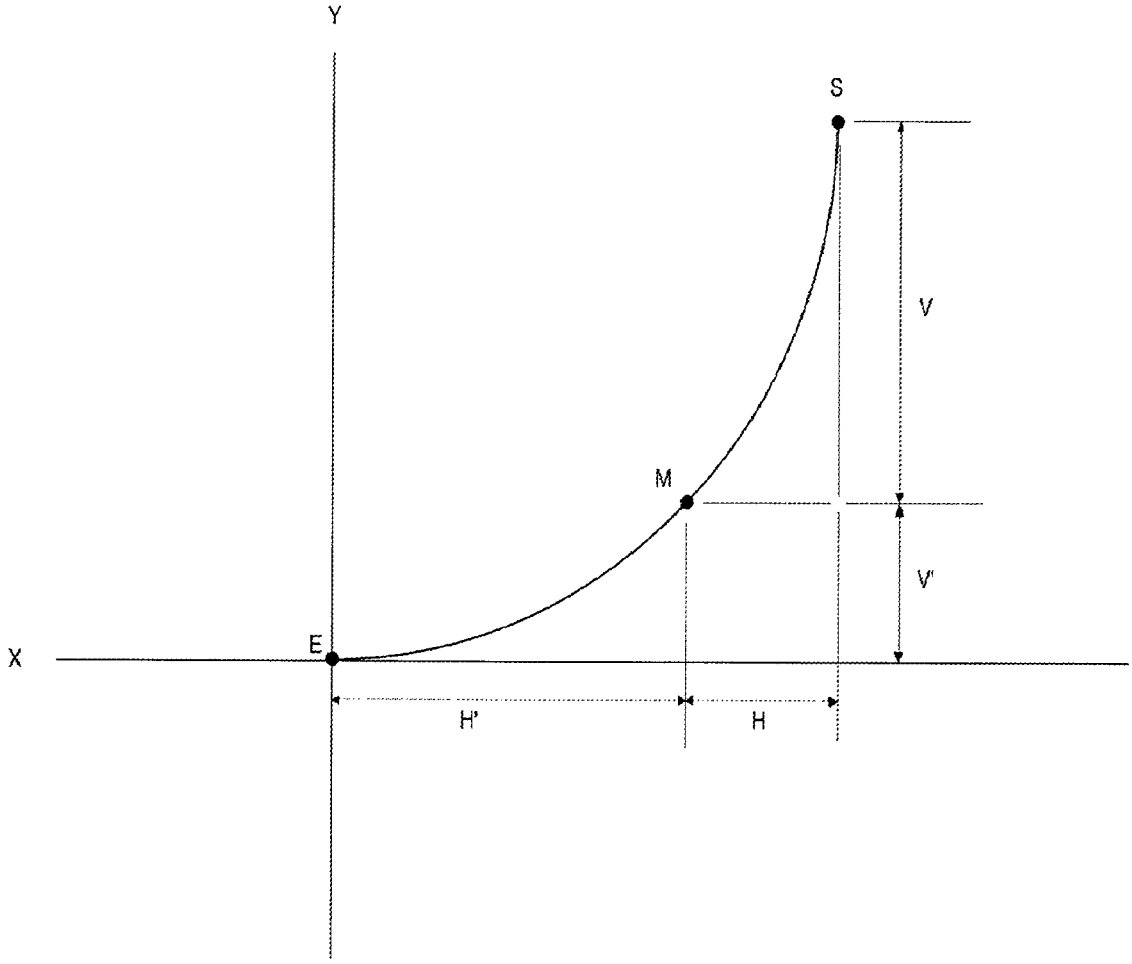
FIG. 7 is a X-Y graph of the path of the user's hands from the start to end positions of the stroke.

FIG. 7 is an X-Y graph of the curve created by one of the user's hands as it travels through the stroke. Vertical displacement lies along the Y axis and horizontal displacement lies along the X axis. Point S denotes the start stroke position. Point M denotes the mid stroke position. Point E denotes the end stroke position. As the hand travels through the arc from Point S to Point M, there is a vertical displacement of V and a horizontal displacement of H. Travelling further from Point M to Point E, there is a vertical displacement of V' and a horizontal displacement of H'. As can be seen from FIG. 7, vertical displacement V is decreasing through the stroke while the horizontal displacement H is increasing through the stroke. Since the hand is following a curve, vertical displacement V is decelerating while horizontal displacement H is accelerating. Referring now to FIG. 3 and FIG. 7, the vertical distance from plane R-R' to plane Q-Q, representing that portion of the stroke equalling the vertical displacement created by the user's upper arm, is not sufficient to span the vertical distance necessary to complete the stroke. Vertical distance from plane Q-Q' to plane O-O' represents the vertical displacement that elbow extension must create to complete the stroke. Furthermore, this elbow extension will suffer a similar type of vertical deceleration as described from FIG. 7. Consequently, as the user performs the stroke, the decelerating elbow extension will make it increasingly more difficult due to the reducing involvement of the tricep muscles.

Figure 8:
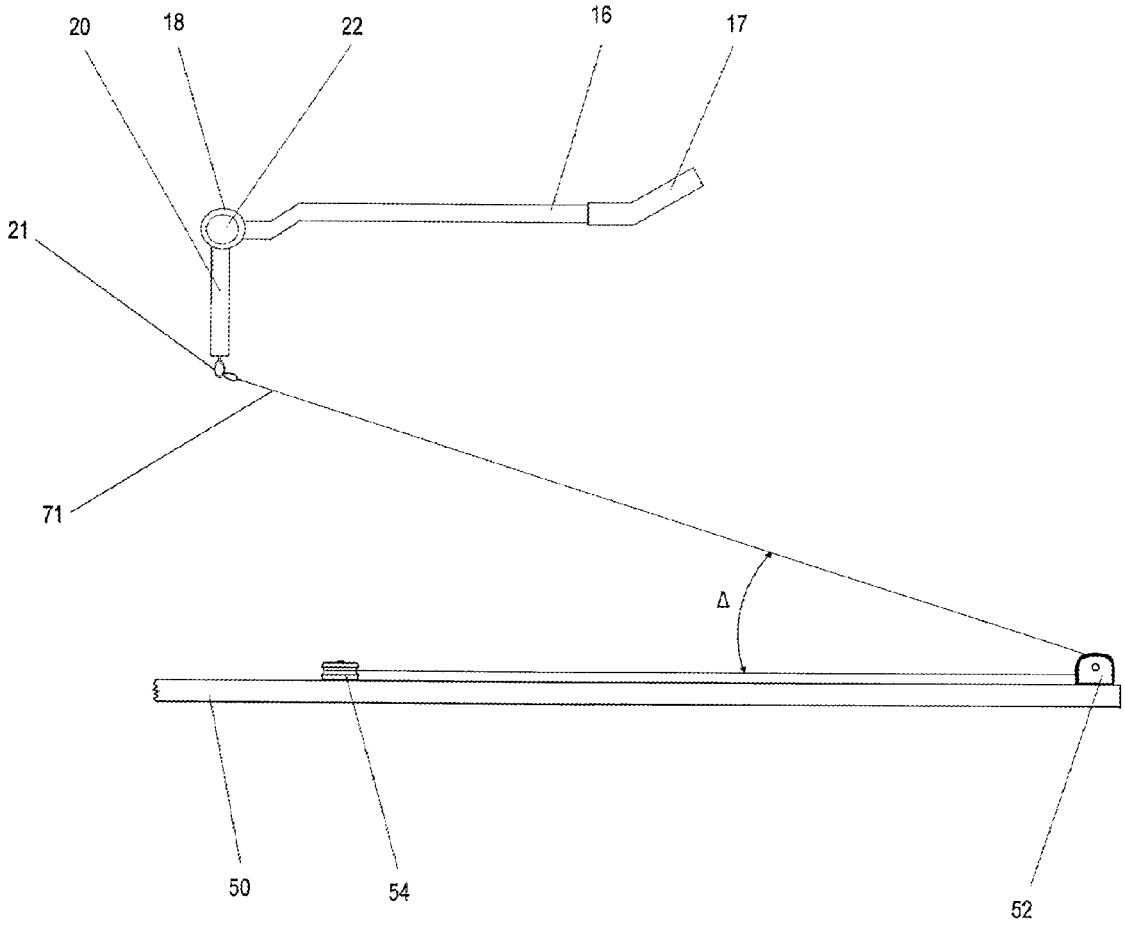
FIG. 8 is a front view illustration of an arm assembly with partial pulley base bar and angular parameter.

Therefore a method of variable resistance is required to counteract this tricep eventuality, otherwise the user will not be able to complete the stroke. In this embodiment of the machine, simple leverage will be utilized to solve this problem. Referring now to FIG. 1 and FIG. 8, as the exercise arm 16 is stroked it is rotated around the arm pivot axle 22. Since the sweep arm 20 is attached to the exercise arm 16, rotating the exercise arm 16 around the arm pivot axle 22 will rotate the swing arm 20 by the same degree. As the sweep arm 20 is rotated, the sweep arm eye-bolt 21 pulls the attached cord 71. The sweep arm eyebolt 21 will trace a circular path. Referring to FIG. 8, as the exercise arm 16 is stroked it will become parallel to the cord 71 at a point I will call maximal cord 71 displacement. Since the eye-bolt 21 is following a curve, vertical and horizontal displacements of the eye-bolt 21 will be accelerations and decelerations of displacements in their respective values as the eye-bolt 21 travels during the stroke. Therefore, from the start of the stroke until maximal cord 71 displacement is reached, leverage at the hand-grip 17 will be decreasing causing effective resistance to be increasing. The angle through which the sweep arm must travel to reach maximal cord 71 displacement is denoted by Δ. From maximal cord 71 displacement until the end of the stroke, leverage at the hand-grip 17 will be increasing causing effective resistance to be decreasing. The angular displacement of the sweep arm from maximal cord 71 displacement to the end of the stroke is 90°−Δ. Furthermore, the initial increase in effective resistance at the hand-grip 17 will be an accelerating increase until the point of maximal cord 71 displacement. From the point of maximal cord 71 displacement until the end of the stroke, effective resistance at the hand-grip 17 will be an accelerating decrease. This effect of decreasing leverage and then increasing leverage facilitates two important functions. Firstly, allowing an angular rotational displacement of Δ before minimal leverage at the hand-grip 17 is reached, allows the user to begin the movement with more weight than the user could stroke otherwise. Upward momentum of the plate stack 60 also helps to assist the higher initial weight. Secondly, the increasing leverage at the hand grips 17 after Δ of rotation has an offsetting effect on the increasing difficulty of the stroke as the tricep muscles become less involved.

Exercise machines of the present invention provide constant and high involvement of the user's chest muscles throughout the entire pressing movement. As mentioned, the stated invention rectifies the problem of diminishing chest involvement in a pressing movement. The present invention creates a scenario where the involvement of the tricep muscles is decreasing as the stroke progresses. Furthermore, since the direction of the force required to move the exercise arms 14 and 16 is constantly changing throughout the stroke, a very high amount of chest muscle fibers become involved in the stroke. In the above stated invention, the direction of the resulting force applied by the user moves through a full range of 90°.

While the foregoing written description of the invention enables one of ordinary skill to make and use said invention, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

I claim:

1. An exercise machine for exercising the chest muscles of a user, comprising:

a frame;

a seat attached to the frame to support a user seated straddling a first vertical plane, and said seat can telescope up and down and move forward and backward to accommodate user;

two front stanchion supports nearer the user and two rear stanchion supports farther from the user attached to the frame, said front and rear stanchions forming a rectangle and bisected by said first vertical plane;

an upper arm pivot axle support member attached horizontally to the said front stanchions and a lower arm pivot axle support member attached horizontally to the said rear stanchions, where the said lower arm pivot axle support member is attached lower vertically on the rear stanchions than the said upper arm pivot axle support member is attached on the front stanchions, by about 7° from the horizontal;

an arm pivot axle attached to the said upper arm pivot axle support member and said lower arm pivot axle support member, said arm pivot axle extending beyond the said stanchion rectangle inwardly towards the user, and said arm pivot axle in alignment with and within the said first vertical plane;

a pair of exercise arms, each having a first end rotatably attached to the said arm pivot axle;

said pair of exercise arms designed to move in a circular convergent motion around the said arm pivot axle, whereby the user's elbow extension suffers a deceleration through the stroke, and said elbow extension requires a lateral movement of the wrist joint;

amount of said elbow extension through the stroke is determined by the forward lean angle of the user;

a second end of said exercise arms designed to accommodate a hand-grip which is grasped and pressed downward and inward toward the mid-line of the user's body, through the circular machine determined path, through 90° of rotation, whereby the direction of the resulting force applied to the said exercise arms at the start position of the stroke is normal to the direction of the resulting force at the end position of the stroke, such that the user's hands meet at the end of the stroke;

said exercise arm's first ends each rotate through a second or third plane, said second and third planes are parallel to each other and displaced perpendicularly from each other by an amount equalling the length of the exercise arm offset;

said hand-grips move in the third vertical plane, closer to the user than the second vertical plane, and said second and third vertical planes are normal to and forwardly declined from the said first vertical plane by about 7°, thus eliminating interference between the user's arms and the rising sweep arms;

said pair of sweep arms rotatably attached at its first end to the arm pivot axle and each of the said exercise arm's first end, wherein the said sweep arm is normal to the said exercise arm and each of the said sweep arms travel through the same vertical planes as their attached exercise arm;

a cord is attached to each of the said sweep arm's second ends, and each of the said cords travel through pulleys to guide the path of the said cords, and each of the said cords are attached to a method of resistance;

each said cord is attached at the sweep arm second end and is directed downward and outward and through the outer pulley located on the pulley base bar on the same side of the said first vertical plane as the said second end of the attached exercise arm, such that the said cord is channelled downward from the horizontal toward the outer pulley at an angle of about 20°, and subsequently through the remaining pulleys;

said pair of sweep arms rotate around the arm pivot axle initially generating a decreasing leverage at the said second end of the exercise arms through the first 20° of rotation, to the point of maximal displacement, and subsequently leverage begins to increase at the said second end of the exercise arms at 20° of rotation;

said hand-grips telescope at their first end and attach to the second end of each exercise arm, thus defining the size of the circular exercise motion path, and second end of said hand-grips is meant to be grasped by the user;

wherein the said hand-grip second end is upwardly angled from the horizontal less than 30°, thus providing angular displacement for the wrist joint to move laterally through the stroke.

2. The machine of claim 1, wherein the said arm pivot axle is forwardly declined from the said first vertical plane by a range in value between 5° and 15°.

3. The machine of claim 1, wherein the point of maximal displacement can begin during the stroke in a range from 0° to 90°.

4. The machine of claim 1, wherein a fourth vertical plane passes through the center of the shoulder joint, elbow joint, and wrist joint such that the said fourth vertical plane is vertical and normal to the first vertical plane, and said fourth vertical plane is backwardly inclined from the third vertical plane by a range in value between 5° and 15° and equal to the value in claim 2.

5. An exercise machine for exercising the chest muscles of a user, comprising:

a frame;

a seat attached to the frame to support a user seated straddling a first vertical plane, and said seat can telescope up and down and move forward and backward to accommodate user;

two front stanchion supports nearer the user and two rear stanchion supports farther from the user attached to the frame, said front and rear stanchions forming a rectangle and bisected by said first vertical plane;

an upper arm pivot axle support member attached horizontally to the said front stanchions and a lower arm pivot axle support member attached horizontally to the said rear stanchions, where the said lower arm pivot axle support member is attached lower vertically on the rear stanchions than the said upper arm pivot axle support member is attached on the front stanchions, by about 7° from the horizontal;

an arm pivot axle attached to the said upper arm pivot axle support member and said lower arm pivot axle support member, said arm pivot axle extending beyond the said stanchion rectangle inwardly towards the user, and said arm pivot axle in alignment with and within the said first vertical plane;

a pair of exercise arms, each having a first end rotatably attached to the said arm pivot axle;

said pair of exercise arms designed to move in a circular convergent motion around the said arm pivot axle, whereby the user's elbow extension suffers a deceleration through the stroke, and said elbow extension requires a lateral movement of the wrist joint;

amount of said elbow extension is determined by the forward lean angle of the user;

a second end of said exercise arms designed to accommodate a hand-grip and be grasped and pressed downward and inward toward the mid-line of the user's body, through the circular machine determined path, through 90° of rotation, whereby the direction of the resulting force applied to the said exercise arms at the start position of the stroke is normal to the direction of the resulting force at the end position of the stroke, such that the user's hands meet at the end of the stroke;

said exercise arm's first ends each rotate through a second or third plane, said second and third planes are parallel to each other and displaced perpendicularly from each other by an amount equalling the length of the exercise arm offset;

said hand-grips move in the third vertical plane, closer to the user than the second vertical plane, and said second and third vertical planes are normal to and forwardly declined from the said first vertical plane by about 7°.

6. The machine of claim 5, wherein the said arm pivot axle is forwardly declined from the said first vertical plane by a range in value between 5° and 15°.

7. The machine of claim 5, wherein a fourth vertical plane passes through the center of the shoulder joint, elbow joint, and wrist joint such that the said fourth vertical plane is vertical and normal to the first vertical plane, and said fourth vertical plane is backwardly inclined from the third vertical plane by a range in value between 5° and 15° and equal to the value in claim 6.

* * * * *